United States Patent [19]

Gagnon

[11] 3,986,279

[45] Oct. 19, 1976

[54] MANUFACTURE OF SAFETY SHOES HAVING RIGID BOX TOES

[75] Inventor: Victor J. Gagnon, Salem, Mass.

[73] Assignee: Bush Universal, Inc., Woburn, Mass.

[22] Filed: Oct. 23, 1975

[21] Appl. No.: 625,174

[52] U.S. Cl. ..... 36/46.5; 36/77 R; 12/146 D

[51] Int. Cl.[2] ..... A43B 23/00

[58] Field of Search ..... 36/77 R, 72 R, 45, 46.5; 12/146 C, 146 D

[56] References Cited

UNITED STATES PATENTS

| | | | |
|---|---|---|---|
| 983,604 | 2/1911 | Cheever | 36/45 |
| 1,919,657 | 7/1933 | Kamborian | 36/46.5 X |
| 2,394,216 | 2/1946 | Susswein | 36/77 R |
| 2,467,388 | 4/1949 | Kamborian | 12/146 D |
| 2,740,209 | 4/1956 | Shultz | 36/77 R |
| 2,756,519 | 7/1956 | Hill | 36/77 R |
| 2,988,829 | 6/1961 | Johnsen | 36/72 R |
| 3,705,463 | 12/1972 | Lown | 36/46.5 X |

*Primary Examiner*—Alfred R. Guest

*Attorney, Agent, or Firm*—Wolf, Greenfield & Sacks

[57] ABSTRACT

A safety shoe having a rigid box toe (such as steel) is assembled by a method in which the steel box is incorporated into the shoe upper before the upper is assembled with the last. The steel box is attached to the upper in a position such that when the upper assembly (including the steel box) is fitted onto the last, a light longitudinal draft of the upper will result. With the upper thus placed on the last, it can be lasted in conventional pulling over and lasting equipment. The upper assembly has only one lastable marginal portion at its toe and forepart region so that only one pulling over and lasting operation is required in order to last the upper about the box toe.

19 Claims, 13 Drawing Figures

FIG. 5
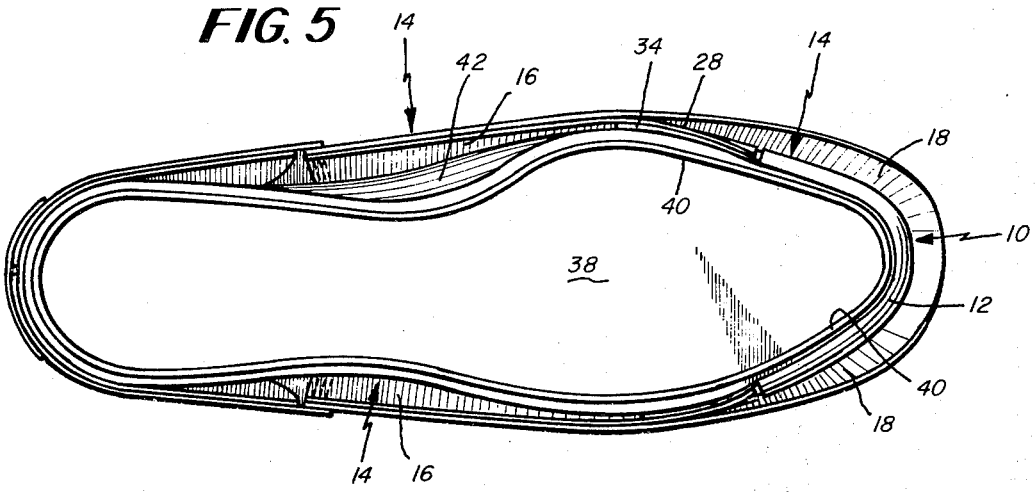
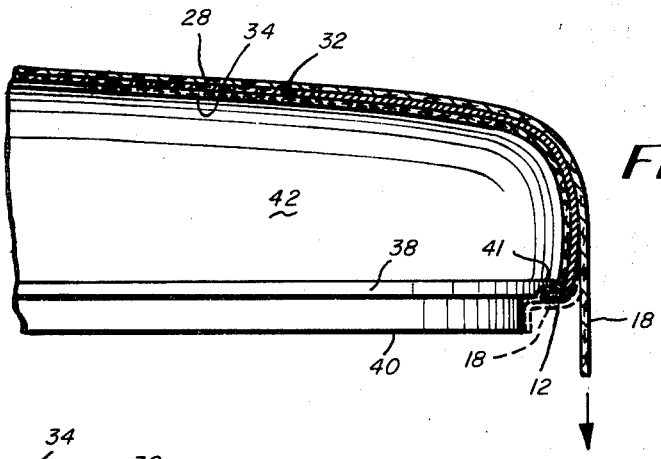
FIG. 6
FIG. 7
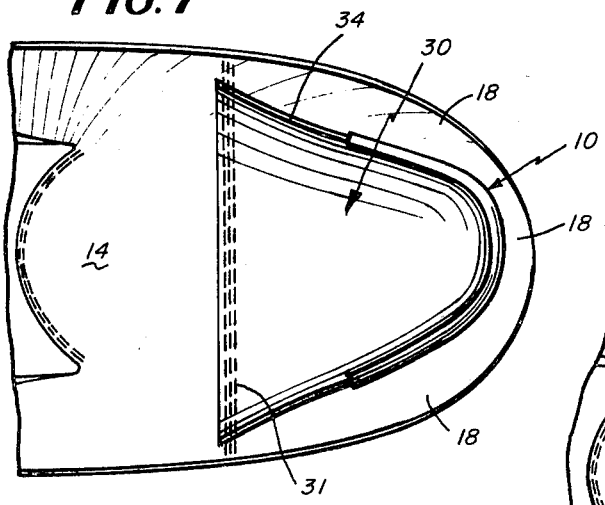
FIG. 8
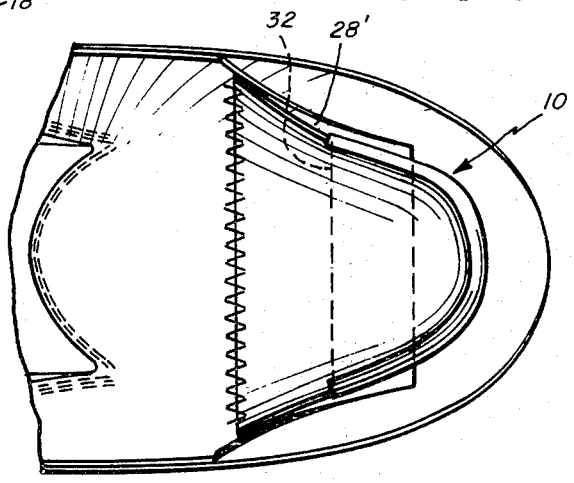

MANUFACTURE OF SAFETY SHOES HAVING RIGID BOX TOES

BACKGROUND OF THE INVENTION

This invention relates to safety shoes which employ rigid box toes, such as steel, to protect the wearer's foot in relatively hazardous environments such as factories, mines, athletic activities, etc. Safety shoes incorporating steel box toes have been in use for many years and can be considered as falling into a number of categories. For example, one such category includes shoes or boots molded from rubber or plastic which incorporate the steel toe but in which there are no lasting or pulling over procedures in the manufacture of the shoe or boot. Another type of steel box toe safety shoe includes a more conventional shoe construction in which an upper is pulled over about the last and is lasted to an insole held in place at the bottom of the last. The safety shoes of the type described may be further categorized and distinguished between those in which the steel box toe is located exteriorly of the upper and those in which the steel box toe is located interiorly of and is concealed by the upper. The present invention relates to improved techniques for manufacturing lasted safety shoes embodying steel box toes which are located beneath and are concealed by the shoe upper.

The manufacture of such shoes typically has presented a number of difficulties, one of which resides in the more complicated manufacturing technique as compared with the lasting of conventional shoes which do not include a steel safety box toe. For example, typical manufacturing procedures which have been employed to construct safety shoes having steel box toes generally require that the individual components of the shoe be built up, piece-by-piece on the last. This is a time consuming, expensive, and highly skilled procedure, all of which contributes to the higher cost of such shoes. Thus, with the typical prior art mode of manufacture, the insole first is temporarily secured to the last bottom. The upper assembly, which includes a lining over the inner surface of the upper, is placed over the last and must be located in proper position on the last. The lining then is pulled over and lasted to the insole in a first pulling over and lasting operation. At least the toe or vamp region of the upper itself necessarily remains unlasted so that it can be peeled back to enable the steel box toe to be inserted between the upper and its lining. After the lining has been securely lasted, the still unlasted upper is peeled back and the steel box toe is placed on the toe of the last over the lining. In addition, various strips of padding or other layers of cushioning material then may be built up on or about the steel box toe at this time. After the steel box toe and any other layers of material associated with it have been placed on the lasted lining, the upper itself then is pulled over and lasted. In some instances, the building up of the steel box toe and associated layers or strips of material also may require the application of an adhesive coating or activation of a previously formed adhesive layer.

From the foregoing, it will be appreciated that the manufacture of lasted steel box toe shoes requires numerous manipulative steps which necessarily increase the expense and skill required in the manufacture of such shoes. Nevertheless, the foregoing manufacturing techniques have been used for many years and still are in substantially widespread universal use.

It is among the primary objects of the invention to provide an improved technique for manufacturing lasted steel box toe safety shoes which avoids many of the foregoing difficulties and procedures.

SUMMARY OF THE INVENTION

This invention relates to an improved manufacturing technique in which the steel box toe is attached to and integrated with the upper assembly before the upper assembly is placed on the last and before any pulling over or lasting has taken place. The upper assembly is constructed so that its lining, at least in the toe and forepart regions, has no marginal portion which must be separately lasted. As a result, only the upper itself need be lasted and only one pulling over and lasting step is required at the toe and forepart region of the shoe assembly.

Various assembly sequences may be employed to attach and integrate the steel box to the upper assembly. In one embodiment, as a preliminary step, a box liner is attached to the inner surface of the steel box toe by adhesive. The liner preferably covers the entire inner surface of the steel toe piece. The box liner has a rear margin which extends rearwardly (heelwardly) beyond the tip line defined by the rear edge of the steel box. The subassembly of the lined steel box toe then is attached directly to the upper by stitching and/or adhering the marginal portion of the box toe liner to the upper or, if the upper has a liner, to the upper liner at the vamp region of the upper/liner subassembly. In an alternative sequence of assembly, the vamp portion of the upper liner is attached to the box liner before either of the liners are attached to the upper or steel box, respectively. The steel box then is attached to the box liner portion and the subassembly of the vamp liner, box liner and steel box then is attached to the upper by stitching and/or cementing the vamp liner to the vamp portion of the upper.

Unlike prior shoes of the steel toe safety type, to the extent that the present invention may include an upper lining, the upper liner does not have a lastable marginal portion at its toe and forepart regions. In one embodiment of the invention, the upper liner extends forwardly only to the rear edge of the steel box toe to enable that portion of the upper liner to overlap and be attached to the rearwardly extending margin of the box toe liner. In other embodiments of the invention, the upper liner may extend partly over the steel box toe but not so far as to present a lastable marginal portion. And in other embodiments, the marginal portion of the box toe liner may be attached directly to the vamp portion of the upper itself.

The upper assembly, including the integrated box toe, then is placed on the last. The entire upper assembly is presented to the pulling over and lasting machine in a pre-assembled condition which completely avoids the piece-by-piece build up of these shoe parts on the last. Because there is no marginal portion of the upper liner to be lasted, only one pulling over and lasting step is required at the toe end of the shoe assembly. The lasting procedure thus is simplified greatly.

In a further aspect of the invention, the box toe is attached at a location such that when the upper assembly with the integrated steel box is placed on the last, a slight toeward tensioning of the upper assembly is required in order to draw or slip the steel box toe over the toe end of the last. This effects a slight longitudinal tensioning or draft on the upper assembly which aids in registering the upper assembly on the last and also helps to hold the upper on the last.

It is among the general objects of the invention to provide an improved technique for assembling steel toe safety shoes.

A further object of the invention is to provide an improved technique for assembling steel box toe safety shoes which requires only a single pulling over and lasting operation at least in the toe region of the shoe and which is useful particularly with combination pulling and lasting machines.

Another object of the invention is to provide a technique for assembling a lasted safety shoe incorporating a steel box toe which avoids piece-by-piece build up of the shoe parts on the last.

A further object of the invention is to provide novel subassemblies usable to construct a safety shoe having a steel box toe.

Another object of the invention is to provide a technique for manufacturing a lasted steel box toe safety shoe which requires a reduced level of skill and which substantially reduces manufacturing costs.

Still another object of the invention is to provide a shoe upper and integrated steel box toe which facilitates placement of the integrated upper and box toe on the last, prepatory to pulling over and lasting.

DESCRIPTION OF THE DRAWINGS

The foregoing and other objects and advantages of the invention will be understood more fully from the following further description thereof, with reference to the accompanying drawings wherein:

FIG. 5 is a bottom view of the upper assembly shown in FIG. 4 when placed on a last and illustrating the longitudinal draft imparted to the upper;

FIG. 6 is a sectional elevation of the toe end of the shoe assembly shown in FIGS. 4 and 5 illustrating the manner in which the upper is pulled over and lasted;

FIG. 7 is an underside illustration of a modified embodiment of the invention in which the box toe subassembly is attached directly to the upper;

FIG. 8 is an underside illustration of a further embodiment of the invention in which the upper liner extends partly over the steel box toe;

DESCRIPTION OF THE PREFERRED EMBODIMENT

Figure 1:
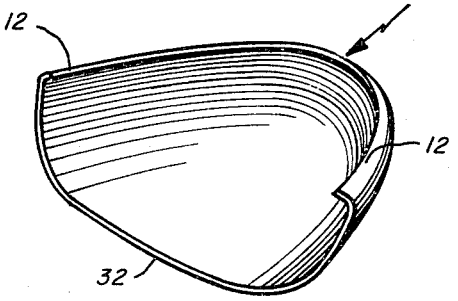
FIG. 1 is an illustration of a typical steel box toe piece.

FIG. 1 shows a typical toe box 10 in an inverted position for clarity. The toe box 10 may be fabricated from steel in accordance with the usual techniques currently employed to make such steel boxes, such as stamping or the like. The toe box 10, however, may be fabricated from other suitable materials displaying the required rigidity and strength. The box 10 typically conforms to the shape of the toe end of the last with which it is to be used. The box 10 includes an inwardly extending lip 12 about its lower edge.

Figure 2:
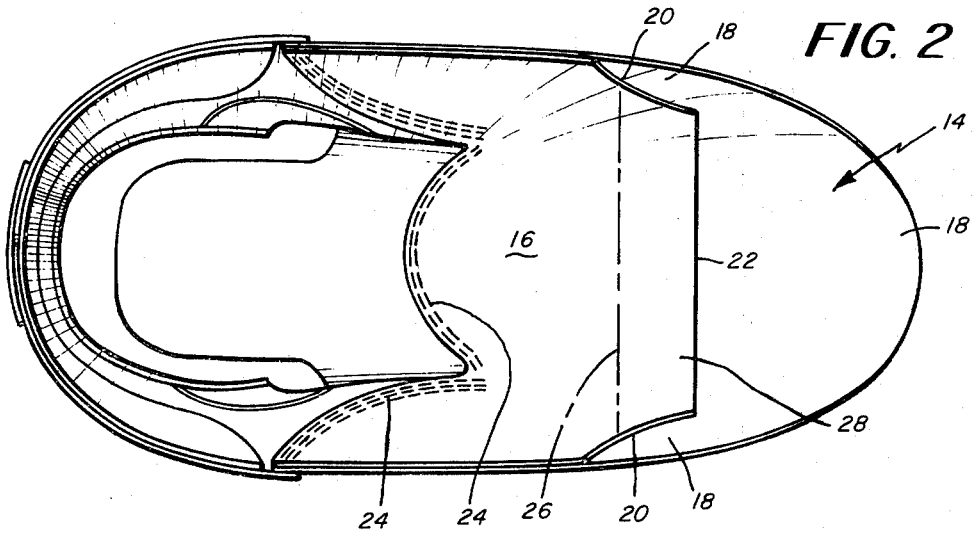
FIG. 2 is an illustration of one embodiment of the inside of an upper having an abbreviated vamp liner in accordance with one embodiment of the invention.

FIG. 2 shows one embodiment of an upper assembly, as seen from its underside, which can be used in the practice of the invention. The upper assembly includes the upper 14 itself which may be of leather or other suitable upper material, as desired. In this embodiment of the invention, the upper assembly has an upper liner 16 attached to the inner surface of the upper. The upper liner 16 may be made from cotton duck, leather or other suitable lining material typically employed in the art. It should be noted that in the conventional manufacture of steel box toe lasted shoes, the upper lining 16 is generally coextensive with the upper 14 and has a lastable marginal portion about its toe and forepart region corresponding to the lastable marginal portion of the upper 14, suggested at 18 in FIG. 2. In the embodiment of the invention shown in FIG. 2, the upper liner 16 is cut so that it has no lastable margin at least in the toe and forepart region of the upper assembly. Thus, as shown in FIG. 2, the marginal edges 20 of the upper liner 16 are not coextensive with the marginal edge of the upper 14, but instead, are disposed well within the edge of the upper. Also, in the embodiment shown in FIG. 2, a substantial portion of the toe region of the upper liner 16 has been cut away so that the upper liner 16 terminates at a foreward edge 22 which is located at or about the intended tip line of the upper assembly. The upper liner 16 is secured to the upper by stitching as suggested at 24 and preferably also is adhesively bonded to the inner surface of the upper. The toewardmost region of the upper liner 16 preferably is not secured to the upper to define somewhat of a flap which may, for example, extend between the line indicated in phantom at 26 in FIG. 2 to the forward edge 22 of the upper liner.

Figure 3:
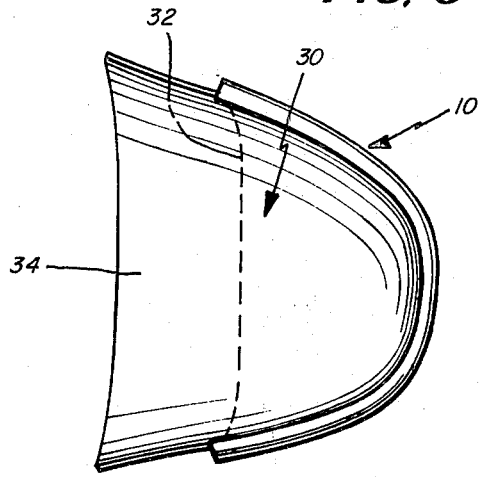
FIG. 3 is an underside illustration of a steel box toe of the type shown in FIG. 1 having the box toe liner attached thereto.

FIG. 3 shows a subassembly of the steel box 10 and box liner 30 which are preliminarily combined as a subassembly in readiness to be attached to the upper assembly shown in FIG. 2. The box liner 30 is cemented to the inner surface of the steel box 10 and, preferably, covers the full inner surface. The box liner 30 may be made from a flexible, soft material, for example, leather. The box liner 30 extends heelwardly and well beyond the tip line 32 of the steel box 10 to define a marginal and flexible extension flap 34.

Figure 4:
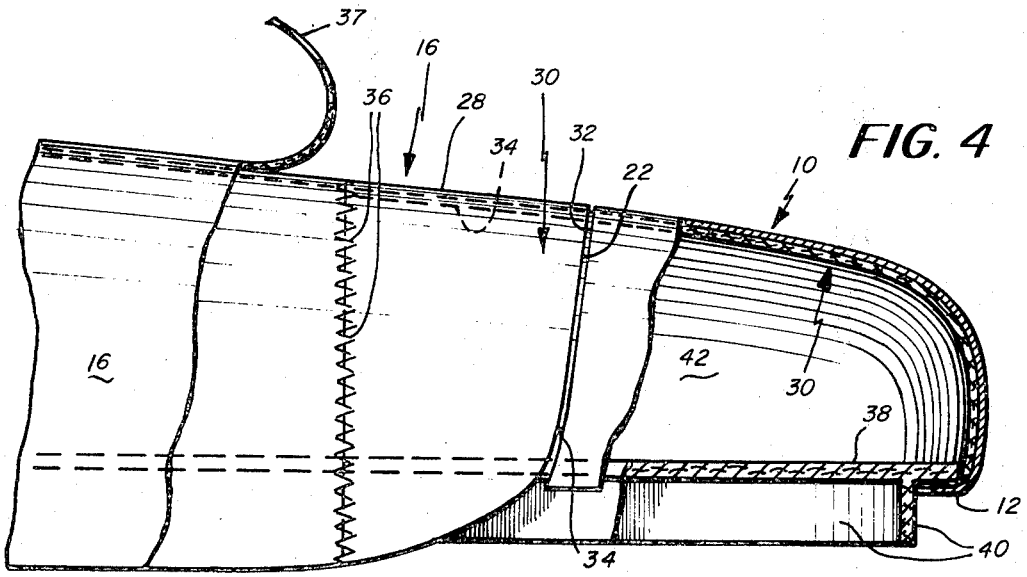
FIG. 4 is an illustration, partly broken away and partly in section, of the lined steel box toe subassembly attached to the upper of FIG. 2.

The lined box subassembly (FIG. 3) then is attached to the upper assembly (FIG. 2) as suggested in FIG. 4. In this embodiment, the extension flap 34 of the box liner 30 is placed beneath the flap 28 at the toeward end of the upper liner 16 and the heelward edge of the extension flap 34 is stitched to the upper flap 28 as suggested at 36 in FIG. 4. In addition to the stitching 36, the overlapping regions of the flap 28 and extension flap 34 may be bonded together by an appropriate adhesive. In the embodiment shown in FIG. 4, the upper flap 28 is trimmed, at the edge 22 so that the edge 22 will lie in close proximity to the tip line 32 of the steel box.

With the box subassembly and upper assembly so combined, the combined assembly then is ready to be placed on the last for the pulling over and lasting operations. The intended position of the combined upper assembly with respect to the insole is suggested in FIG. 4 which shows the relative location of the insole 38 and insole rib 40 where the shoe is to be a welt shoe, as is often the case in lasted steel box toe shoes. As can be seen from FIG. 4, the lip 12 of the steel box 10 is intended to hook over and underlie the outer marginal portion of the insole about the toe and forepart region. FIG. 5 shows the combined assembly which has been placed on the last 42 and as seen from the bottom of the last. The shape of the steel box 10 enables the upper assembly to be placed on the last in a manner which tends to aid in holding the upper assembly on the last without tacks or other supplemental upper holding devices. This is achieved by attaching the steel box subassembly to the upper assembly at a location which will require a slight longitudinal stretching or drafting of the upper to enable the heel and toe ends of the assembled upper to be slipped over the last. Thus, the steel box is located in the upper assembly so that it is spaced from the heel end of the upper assembly slightly less than the longitudinal dimension of the last to require a slight stretching of the upper in order to slip the upper assembly onto the last. Because of this slight tensioning, the toe-shaped rigid steel box 10 and heel portion of the upper engage the heel and toe ends of the last and tend to hold the upper assembly in that position. As can be seen from FIG. 5, when the upper assembly has been slipped onto the last, the sides of the upper 14 are drafted lengthwise of the shoe assembly.

When the upper assembly is placed on the last, the vamp portion of the upper 14 which extends toewardly of the region of attachment of the upper 14 and upper liner 16 simply lies loosely atop the last and extends beyond the periphery of the toe and forepart region of the last in readiness to be pulled over and securely lasted to the insole. The more heelward portions of the upper 14 are tensioned as illustrated in FIG. 5. There is no marginal portion of an upper liner to be lasted, at least in the toe and forepart regions of the shoe assembly. The upper 14 may then be pulled over as shown in solid FIG. 6 and then wiped inwardly against the insole in the usual manner as suggested in phantom in FIG. 6. In this regard it may be noted that the insole 38 typically will be fabricated from a somewhat crushable material and, when the force of the wipers is applied during the lasting step, the outer marginal portion (indicated at 41 in FIG. 6) of the insole may be crushed between the last and the lip 12 of the steel box 10 so that after the lasting step has been completed, the lower surface of the lip 12 will be at or near the general level of the lower surface of the insole bottom.

From the foregoing it will be appreciated that only one pulling over and lasting operation is required in the toe region and the numerous manipulative steps typically employed in the prior art to build up the steel box toe region, piece-by-piece on the last and after the upper liner has been lasted are avoided.

Various modifications may be made in the practice of the invention. For example, FIG. 7 illustrates an arrangement in which the liner 30 of the steel box subassembly is attached directly to the upper 14 by stitching and/or adhesive. In this embodiment the upper may be totally free of any lining or the lining may be completely integral with the upper so as to still require only a single lasting step. Here, however, it is preferred to employ a more aesthetically appealing stitch configuration, because the stitches will be exposed on the outside of the upper. Thus, as shown in FIG. 7, there are two or three rows of parallel stitching indicated at 31.

FIG. 8 shows another embodiment somewhat similar to the embodiment originally described except that the flap 28' of the upper liner extends forwardly beyond the tip line 32 of the steel box 10. Here, as with the first described embodiment, the margin of the upper liner in the toe region is cut back so that it presents no lastable marginal portion. The flap 28' of the upper liner which overlies the steel box may, if desired, be adhesively bonded to the steel box.

Figure 9:
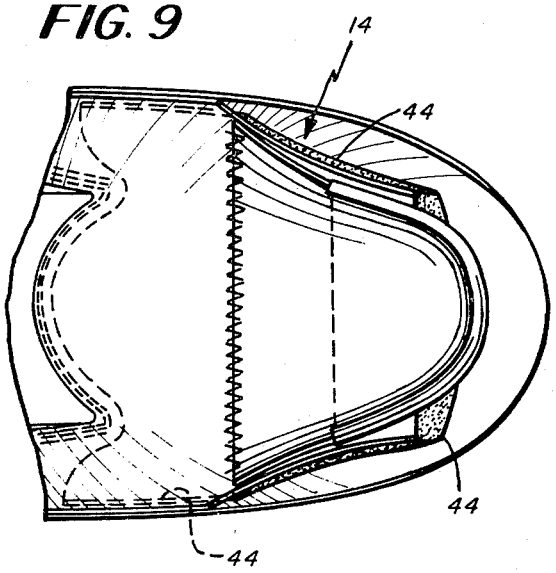
FIG. 9 is an underside illustration of a further embodiment of the invention in which the upper liner extends partly over the steel box toe and with part of the upper liner being formed from a foam material.

FIG. 9 shows a further embodiment of the invention similar to that shown in FIG. 8 except that a cushioning layer 44, for example, foam rubber or plastic, is secured to the inner surface of the upper 14 to provide a better "feel" for that portion of the upper which overlies the steel box. The cushioning layer 44 preferably covers and overlaps at least the tip line 32 of the steel box to preclude "shadowing through" of the tip line of the box through the upper.

Figure 10:
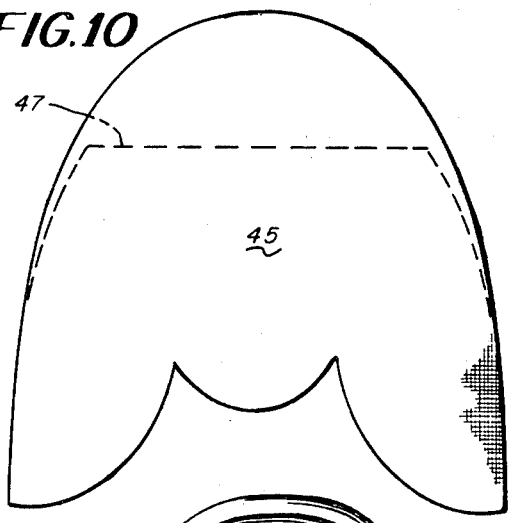
FIG. 10 is a plan illustration of the shape of a typical vamp liner and illustrating a manner in which it may be modified to practice the invention.
Figure 11:
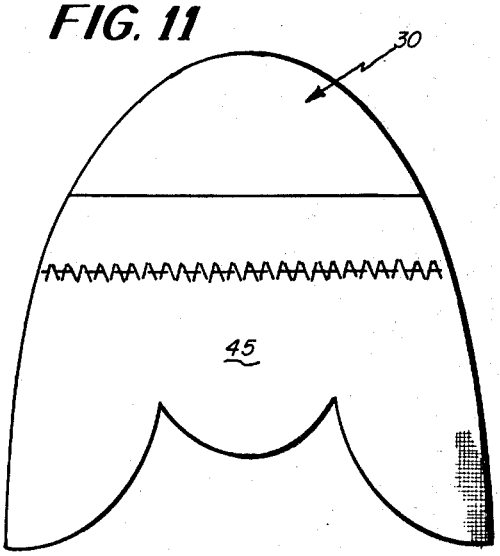
FIG. 11 is a plan illustration of the modified vamp liner of FIG. 10 with the box toe liner attached.
Figure 12:
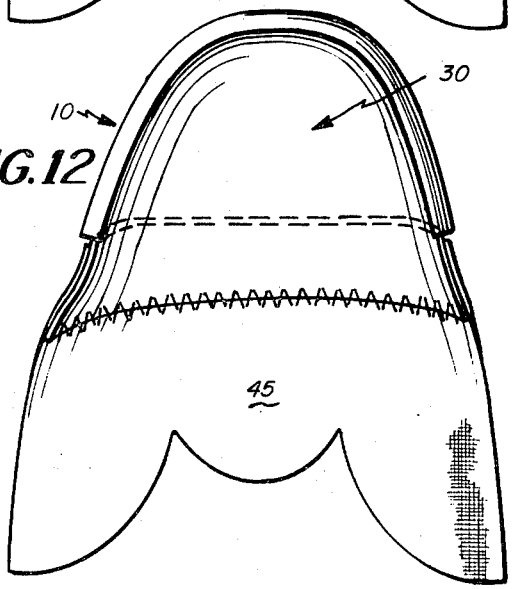
FIG. 12 is an illustration of the subassembly of FIG. 11 with the steel box attached.

While the invention has been described thus far as employing a technique in which the steel box 10 first is lined with the liner 30 to form one subassembly which then is combined with the upper assembly shown in FIG. 2, the invention is not limited to such a sequence and, in fact, there may be many instances in which other sequences will be preferred. For example, it should be noted that it is a common practice in the shoe art to assemble an upper from various segments and in which liners are attached to the individual upper segments before the upper segments are attached to each other. For example, FIG. 10 illustrates a typical configuration for vamp liner 45 (which is of the same shape as the vamp portion of the upper). The vamp liner 45 typically is attached to the vamp portion of the upper before the vamp is stitched to the other upper portions. When such a sequence of upper assembly is employed, the invention may be incorporated as suggested in FIGS. 10 and 11. The vamp liner 45 is trimmed as suggested in phantom at 47 (or may be initially cut) so that it will have no lastable marginal portion extending about its toe and forepart region. The box liner 30 then is stitched and adhesively bonded to the vamp liner 45 (FIG. 11) and, after the liner segments 30, 45 have been attached, the box liner is attached to the inner surface of the toe box 10 to form a subassembly shown in FIG. 12. The vamp liner then can be stitched and/or cemented to the inner surface of the vamp portion of the upper, and the lined vamp with steel box attached then can be stitched to the other segments of the upper in the usual manner. When the upper has been completely assembled, it is then ready to be placed on the last as described above and as illustrated in FIGS. 4 and 5.

In a variation of the assembly technique described above and illustrated in FIGS. 10–12, there may be instances in which the material selected for the upper lining is itself suitable as a liner for the box toe piece 10. For example, this may occur when the shoe upper is to be lined with leather. When this is the case, the vamp liner may be cut from a single piece of the lining material to the shape shown in FIG. 11. The cut combination vamp and box liner then is attached to the box (as suggested in FIG. 12) and that subassembly is then attached to the vamp segment of the upper as described above.

Figure 13:
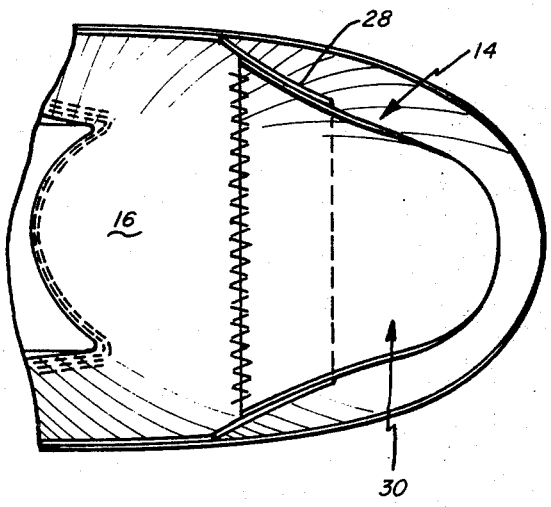
FIG. 13 is an underside illustration of a further embodiment of the invention in which the box toe liner is attached to the upper liner before the box toe liner and steel box are combined.

Still other procedures may be followed, depending on the practices of the manufacturer and other manufacturing considerations. Thus, an alternative procedure might be to first attach the box liner 30 to the pre-lined upper assembly, either directly to the upper or as suggested in FIG. 13, or to a flap portion 28 of the upper liner. After the box liner 30 has been attached, the steel box 10 can be cemented to the box liner 30. The resulting combined upper assembly then may be placed on the last, pulled over and lasted as described above.

Thus, it will be seen that by preliminarily attaching the steel box to the upper assembly before the upper assembly is placed on the last and before any pulling over or lasting steps have occurred, significant advantages in the manufacture of such shoes are achieved. The double pulling over and lasting operation heretofore employed are reduced to a single pulling over and lasting step in which only the upper itself is pulled and lasted. Additionally, the numerous steps which have been required in the piece-by-piece building up of the steel box toe region on the last and while in the lasting machine are avoided. When the shoe is finally assembled, the steel box is enclosed between the upper and the box liner. The inner surface of the box is smooth and will be soft and comfortable, depending on the quality of the box liner material. With the foregoing technique of preliminarily assembling the steel box with the upper, there is no tendency for the steel box to shift about during the pulling and lasting procedure because the steel box has already been secured to the upper before the lasting process.

It should be understood, however, that the foregoing description of the invention is intended merely to be illustrative thereof and that other modifications and embodiments may be apparent to those skilled in the art without departing from its spirit.

Having thus described the invention, what I desire to claim and secure by Letters Patent is:

1. In the manufacture of lasted safety box toe shoes, an improved method comprising:

providing an upper assembly having only one lastable margin about its toe and forepart region;

attaching a rigid box toe to the upper assembly; and thereafter placing the combined upper assembly and box toe on a last having an insole at the bottom thereof in readiness for lasting the toe and forepart regions of the upper.

2. A method as defined in claim 1 wherein the upper has an upper liner attached thereto, said method further comprising:

forming the upper liner so that it is free of any lastable margin at the toe and forepart regions thereof and with the toeward end of the upper liner being unattached to the upper to define a flap; and securing the box to the flap of the upper liner.

3. A method as defined in claim 1 wherein said step of attaching the rigid box toe to the upper comprises:

preliminarily lining the inner surface of the rigid box with a liner having a flap extending heelwardly beyond the tip line of the box and attaching the flap to the upper assembly.

4. A method as defined in claim 3 in which the upper has a liner attached thereto, said method further comprising:

forming the upper liner so that it is free of any lastable margin at the toe and forepart regions thereof and with the toeward end of the upper liner being unattached to the upper to define a flap; and securing the flap of the box liner to the flap of the upper liner.

5. A method as defined in claim 4 wherein the flap of the upper liner is attached to the flap of the box so that the upper liner terminates at the tip line of the box.

6. A method as defined in claim 1 wherein said step of attaching the rigid box toe to the upper further comprises:

locating the box on the upper in a position which will require a longitudinal drafting of the upper when the combined upper and box toe are fitted onto the last and securing the box to the upper in that position.

7. A method as defined in claim 6 wherein the location at which the box is attached to the upper is such as will require a longitudinal drafting of the upper sufficiently to enable the upper to hold itself onto the last.

8. A method as defined in claim 1 further comprising interposing a layer of cushioning material between the box and the upper.

9. A method as defined in claim 1 wherein said step of attaching the box to the upper comprises:

attaching a box liner to the upper assembly and thereafter attaching the box to the box liner.

10. In the manufacture of lasted safety box toe shoes, an improved method comprising:

providing a plurality of upper segments including a vamp segment;

providing a liner for the vamp segment, the liner being of reduced marginal dimensions about its toe and forepart region so that when the vamp liner is attached to the vamp segment the marginal portion of the vamp segment will be exposed;

attaching a box liner to the toeward end of the vamp liner;

then securing the toe box to the box liner;

thereafter securing the vamp liner to the vamp; and thereafter securing the assembly of the vamp, vamp liner, box liner and the box to the remaining upper segments.

11. In the manufacture of lasted safety box toe shoes, an improved method comprising:

providing an upper vamp segment;

providing a liner for the upper vamp segment, the liner being cut back about its toe and forepart marginal region;

securing the vamp liner to the inner surface of a rigid toe box to line the inner surface of the toe box;

thereafter securing the combined liner and toe box to the vamp segment.

12. An article for use in the manufacture of lasted steel box toe shoes comprising:

an upper assembly having only one lastable margin in the toe and forepart region of the upper;

a rigid box toe attached to the upper at a location which will enable the combined upper and box to be positioned on a last in readiness for lasting.

13. An article as defined in claim 12 further comprising:

the box being located on the upper in a longitudinal position which will require a slight longitudinal drafting of the upper to fit the upper onto the last.

14. An article as defined in claim 12 further comprising:

a box liner attached to the liner surface of the box and extending heelwardly from the tip line of the box, the heelwardly extending flap of the box liner being attached to the upper assembly.

15. An article as defined in claim 14 wherein at least the flap portion of the box liner is flexible.

16. An article as defined in claim 14 further comprising:

the upper having an upper liner attached to the inner surface thereof, the upper liner having a flap at its toeward regions, said upper liner flap being overlapped with and attached to the flap of the box liner.

17. An article for use in the manufacture of lasted safety box toe shoes comprising:

a vamp liner having a toe and forepart region which is abbreviated at least about its marginal toe and forepart regions thereof; and a box liner secured to and extending toewardly from the vamp liner.

18. An article as defined in claim 17 further comprising:

a rigid box toe piece;

said box liner portion of said combined vamp and box liner being secured to the inner surface of said toe box.

19. An article for use in the manufacture of lasted steel box toes comprising:

a steel box;

a flexible, soft liner attached to the inner surface of the steel box and having a flap extending rearwardly of the tip line of the box.

* * * * *